US005195637A

United States Patent [19]

Weder

[11] Patent Number: 5,195,637

[45] Date of Patent: * Mar. 23, 1993

[54] SHIPPING CARTON FOR FLORAL GROUPING ASSEMBLIES

[75] Inventor: Donald E. Weder, Highland, Ill.

[73] Assignee: Highland Supply Corporation, Highland, Ill.

[ * ] Notice: The portion of the term of this patent subsequent to Sep. 22, 2009 has been disclaimed.

[21] Appl. No.: 868,068

[22] Filed: Apr. 13, 1992

Related U.S. Application Data

[63] Continuation of Ser. No. 831,767, Feb. 5, 1992, Pat. No. 5,148,918, which is a continuation-in-part of Ser. No. 692,329, Apr. 26, 1991, Pat. No. 5,092,465.

[51] Int. Cl.[5] ..... B65D 85/50; B65D 85/52

[52] U.S. Cl. ..... 206/423; 206/813

[58] Field of Search ..... 206/423, 813

[56] References Cited

U.S. PATENT DOCUMENTS

| | | | |
|---|---|---|---|
| 1,064,813 | 6/1913 | Bloomberg . | |
| 2,165,539 | 7/1939 | Dahlgren . | |
| 2,373,634 | 4/1945 | Wagner | 206/813 X |
| 2,744,624 | 5/1956 | Hoogstoel et al. . | |
| 3,322,323 | 5/1967 | Greene et al. | 206/813 X |
| 3,389,784 | 6/1968 | Hendricks et al. | 206/813 X |
| 3,883,990 | 5/1975 | Stidolph . | |
| 3,924,354 | 12/1975 | Gregoire . | |
| 4,053,049 | 10/1977 | Beauvais . | |
| 4,396,120 | 8/1983 | Morita . | |
| 4,470,508 | 9/1984 | Yen | 206/813 X |

FOREIGN PATENT DOCUMENTS

| | | | |
|---|---|---|---|
| 192843 | 11/1957 | Austria | 206/813 |
| 26878 | of 1913 | United Kingdom | 206/813 |

*Primary Examiner*—William I. Price

*Attorney, Agent, or Firm*—Dunlap, Codding & Lee

[57] ABSTRACT

A shipping carton including a box assembly and a plurality of floral grouping assemblies. The box assembly has an inner surface partially enclosing a retaining space. An adhesive or cohesive is applied to at least a portion of the inner surface of the box assembly. The floral grouping assemblies are disposed in the retaining space and a portion of each of the floral grouping assemblies is removably and adhesively or cohesively connected to the box assembly for preventing substantial movement of the floral grouping assemblies during shipment.

6 Claims, 11 Drawing Sheets

SHIPPING CARTON FOR FLORAL GROUPING ASSEMBLIES

RELATED REFERENCES

This application is a continuation of U.S. Ser. No. 831,767, filed Feb. 5, 1992, now U.S. Pat. No. 5,148,918 entitled, "SHIPPING CARTON FOR FLORAL GROUPING ASSEMBLIES" which U.S. Ser. No. 831,767 is a continuation-in-part of U.S. Ser. No. 692,329, filed Apr. 26, 1991, entitled, "SHIPPING CARTON FOR FLORAL GROUPING ASSEMBLIES", now U.S. Pat. No. 5,092,465.

FIELD OF THE INVENTION

The present invention generally relates to a box containing floral groupings wherein adhesive is applied to a portion of the box and/or a portion of a box lid and the floral grouping assemblies are disposed in the box and positioned so that the adhesive removably and adhesively connects the floral grouping assemblies to the box or box lid for substantially preventing movement of the floral grouping assemblies in the box during shipment.

BRIEF DESCRIPTION OF THE DRAWINGS

FIG. 8 is a partial perspective view of a box assembly similar to the box assembly shown in FIG. 1, except showing a cohesive on the box.

FIG. 9 is a partial elevational view of the box assembly of FIG. 8 showing a plurality of floral grouping assemblies disposed in the box.

DESCRIPTION OF THE PREFERRED EMBODIMENTS

Figure 1:
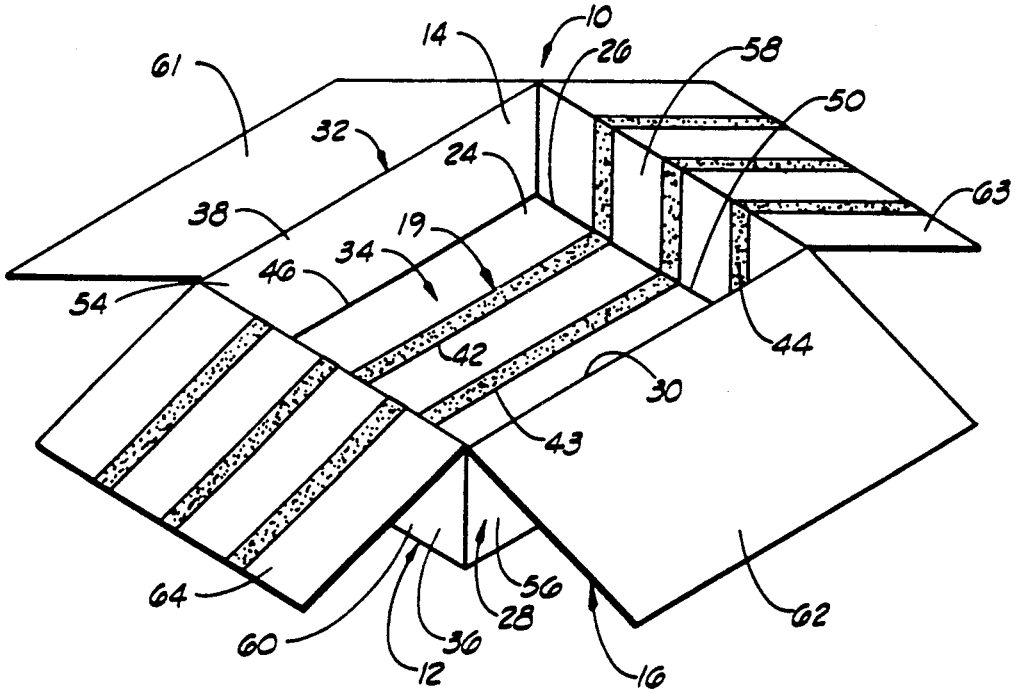
FIG. 1 is a partial perspective view of a box assembly comprising a box and a box lid constructed in accordance with the present invention.
Figure 2:
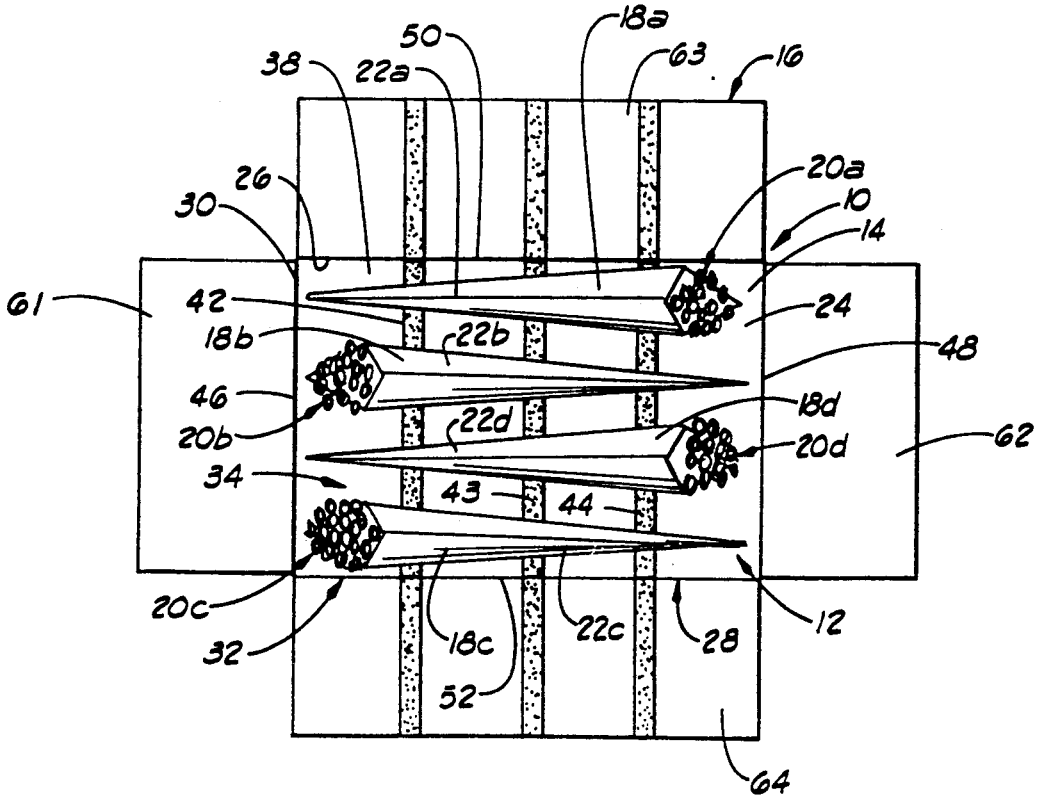
FIG. 2 is a partial elevational view of the box assembly of FIG. 1 showing a plurality of floral grouping assemblies disposed in the box.

Shown in FIGS. 1 and 2 is a shipping carton which is constructed in accordance with the present invention and designated by the general reference numeral 10. The shipping carton includes a box assembly 12. The box assembly 12 comprises a box 14 and a box lid 16.

The box assembly 12 is particularly shaped and sized to accommodate a plurality of floral grouping assemblies 18 (FIG. 2) with the various floral grouping assemblies being designated in FIG. 2 by the respective reference numerals 18*a*, 18*b*, 18*c* and 18*d*. The box assembly 12 includes an adhesive 19 applied to a portion of the box assembly 12.

In operation, the floral grouping assemblies 18 are disposed in the box 14. The adhesive 19 is positioned on the box assembly 12 such that the adhesive 19 removably and adhesively connects the floral grouping assemblies 18 to a portion of the box assembly 12 for substantially preventing movement of the floral grouping assemblies 18 in the box 14 during movements of the box 14 or, more particularly, during movements of the box 14 during shipment with the floral grouping assemblies 18 contained therein.

Each floral grouping assembly 18 comprises a floral grouping 20 (FIG. 2) with the individual floral groupings 20 being specifically designated in FIG. 2 by the reference numerals 20*a*, 20*b*, 20*c* and 20*d*. Each floral grouping assembly 18 also comprises a sleeve 22 which may be constructed of paper or other suitable material, with each sleeve being designated by the specific reference numerals 22*a*, 22*b*, 22*c* and 22*d* in FIG. 2. Each sleeve 22 is disposed generally about a lower end portion of one of the floral groupings 18. Sleeves which are constructed to be disposed about lower end portions of floral groupings or about entire floral groupings such as the sleeve 22 are well known in the art and a detailed description of the construction and operation of such sleeves is not deemed necessary herein.

The term "floral grouping" as used herein means cut fresh flowers, artificial flowers, other fresh and/or artificial plants or other floral materials and may include other secondary plants and/or ornamentation which add to the aesthetics of the overall floral grouping.

The box 14 comprises a base 24 having an outer periphery 26. The side walls 28 are connected to the base 24, and the side walls 28 extend about the outer periphery 26 of the base 24. Each of the side walls 28 extends a distance about perpendicularly from the base 24 with the side walls 28 terminating with an upper end 30 forming an open upper end 32 of the box 14. The side walls 28 and the base 24 cooperate to partially enclose a retaining space 34.

The box 14 has an outer surface 36 and an inner surface 38. The outer and the inner surfaces 36 and 38 each are formed by portions of the base 24 and portions of the side walls 28.

The adhesive 19 more particularly comprises a pair of three adhesive strips 42, 43 and 44. The adhesive strip 42 extends along portions of the inner surface 38 formed by the side walls 28 and extends over a portion of the inner surface 38 formed by the base 24. The adhesive strip 43 also extends along a portion of the inner surface 38 formed by the side walls 28 and over a portion of the inner surface 38 formed by the base 24. The adhesive strip 44 extends along a portion of the inner surface 38 formed by the side walls 28 over a portion of the inner surface 38 formed by the base 24. The adhesive strip 42 is spaced a distance from the adhesive strip 43, and the adhesive strip 43 is spaced a distance from the adhesive strip 44.

The base 24 more particularly comprises a first end 46, a second end 48, a first side 50 and a second side 52. The base 24 generally is rectangularly shaped. As shown in FIG. 1, the side walls 28 more particularly comprise a first end wall 54, a second end wall 56, a first side wall 58 and a second side wall 60. The first end wall 54 is connected to the base 24 and extends generally along the first end 46 of the base 24. The second end wall 56 is connected to the base 24 and extends generally along the second end 48 of the base 24. The first side wall 58 is connected to the base 24 and extends generally along the first side 50 of the base 24. The second side walls 60 is connected to the base 24 and extends generally along the second side 52 of the base 24. The first end wall 54, the second end wall 56, the first side 58 and the second side wall 60 are interconnected to form the continuous side wall 28 extending about the outer periphery 26 of the base 24.

The adhesive strip 42 more particularly extends along a portion of the first side wall 58, along a portion of the base 24 and along a portion of the second side wall 60. The adhesive strip 43 more particularly extends along a portion of the first side wall 58, along a portion of the base 24 and along a portion of the second side wall 60. The adhesive strip 44 more particularly extends along a portion of the first side wall 58, along a portion of the base 24 and along a portion of the second side wall 60.

The box lid 16 comprises a first lid flap 61, a second lid flap 62, a third lid flap 63 and a fourth lid flap 64. The first lid flap 61 is connected to an upper end of the first end wall 54, the first lid flap 61 extending along the entire length of the first end wall 54 and extending a distance therefrom. The second lid flap 62 is connected to an upper end of the second end wall 56 and extends along the entire length of the upper end of the second end wall 56 and a distance therefrom. The third lid flap 63 is connected to an upper end of the first side wall 58 and extends along the entire length of the first side wall and a distance therefrom. The fourth lid flap 64 is connected to an upper end of the second side wall 60 and extends along the entire length of the second side wall 60 and a distance therefrom. The lid flaps 61, 62, 63 and 64 are shown in FIGS. 1 and 2 in the opened position wherein each of the lid flaps 61, 62, 63 and 64 are removed from the opened upper end 32 of the box 14.

Each of the lid flaps 61, 62, 63 and 64 is movable to a position wherein each of the lid flaps 61, 62, 63 and 64 extends over a portion of the opened upper end 32 of the box 14 and generally over at least a portion of the retaining space 34. The lid flaps 61, 62, 63 and 64 cooperate with the box 14 to substantially enclose and encompass the retaining space 34 in the closed position of the lid flaps 61, 62, 63 and 64.

A portion of the adhesive strips 42, 43 and 44 extend over the third lid flap 63 and another portion of the adhesive strips 42, 43 and 44 extend over a portion of the fourth lid flap 64.

After the floral groupings 18 have been disposed in the retaining space 34, the third and the fourth lid flaps 63 and 64 are moved to the closed position wherein the portions of the adhesive strips 42, 43 and 44 on each of the respective third and fourth lid flaps 63 and 64 contactingly engages the sleeves 22 of the floral grouping assemblies 18. The portions of the adhesive strips 42, 43 and 44 on the base 24 also engages the sleeves 22 of the floral groupings assemblies 18 for adhesively connecting the floral groupings 22 to the base 24 of the box 14. The portions of the adhesive strips 42, 43 and 44 on the third and fourth lid flaps 63 and 64 also engages and adhesively connects portions of the sleeves 22 to the third and fourth lid flaps 63 and 64. The adhesive strips 42, 43 and 44 on the base 24 and the third and fourth lid flaps 63 and 64 cooperate to adhesively and releasably connect the floral grouping assemblies 18 to the box 14 and to portions of the box lid 16 for substantially preventing movement of the floral grouping assemblies in the box assembly 12 during shipment of the box assembly 12.

After the third and fourth lid flaps 63 and 64 have been moved to the closed position, the first and the second lid flaps 61 and 62 then each are moved to the closed position generally overlaying the third and fourth lid flaps 63 and 64. The first and second lid flaps 61 and 62 then may be secured in this closed position via an adhesive tape or other securing means thereby securing all of the lid flaps 61, 62, 63 and 64 in the closed position covering the floral grouping assemblies 18.

EMBODIMENT OF FIGS. 3 AND 4

Figure 3:
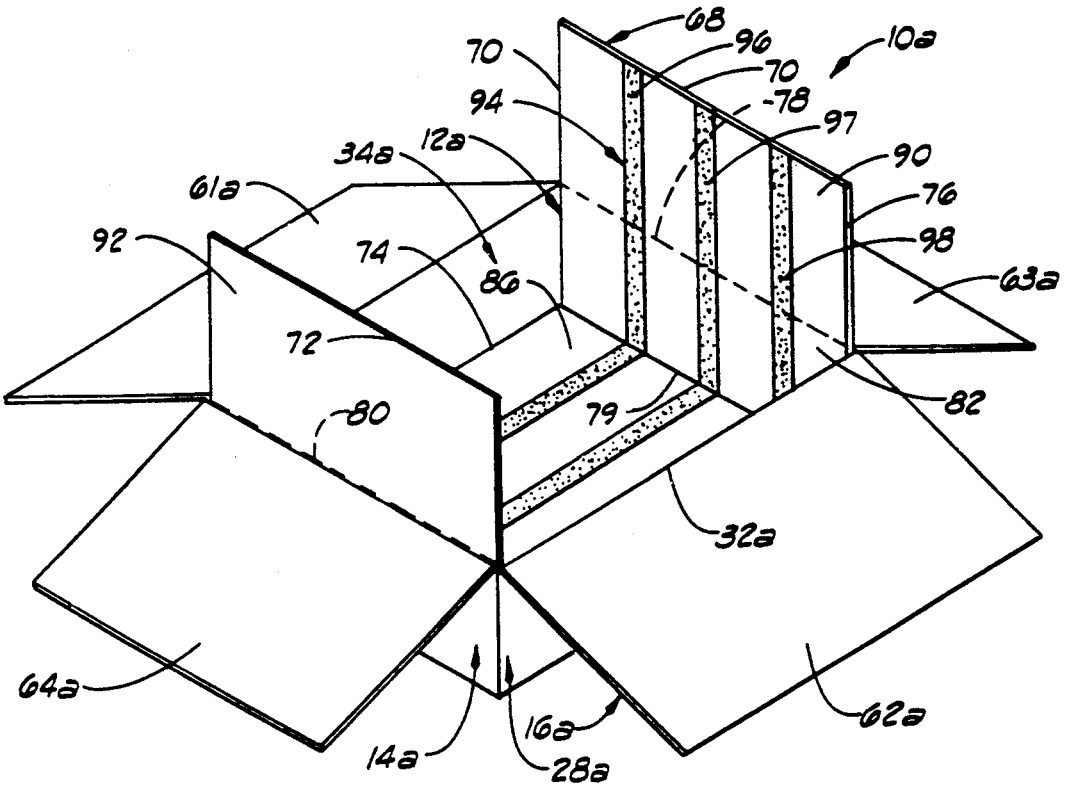
FIG. 3 is a partial elevational view of a modified box assembly wherein the box assembly comprises a box lid, a box and wherein the box comprises a box insert.

Shown in FIG. 3 is a modified box assembly 12*a*. The box assembly 12*a* includes a box 14*a* which is constructed exactly like the box 14 shown in FIGS. 1 and 2 and described in detailed before, except the box 14*a* does not include adhesivě or adhesive strips on any portion thereof like the adhesive 19 comprised of the adhesive strips 42, 43 and 44 on the box 14, and the box lid 16 does not include adhesive or adhesive strips on any portion thereof like the adhesive 19 comprised of the adhesive strips 42, 43 and 44 on the third and fourth lid flaps 63 and 64 of the box lid 16.

Figure 4:
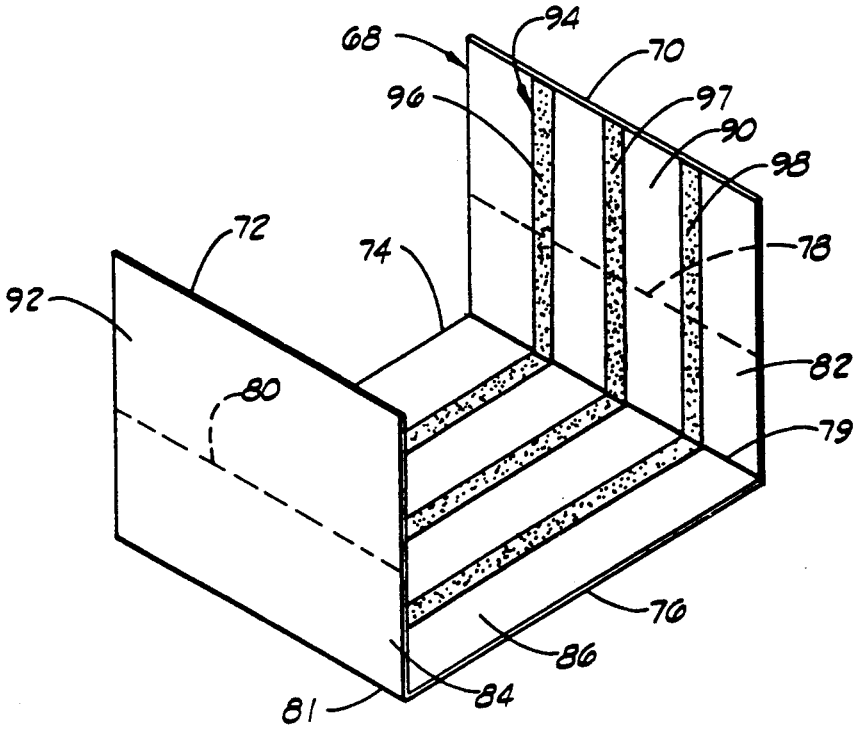
FIG. 4 is a partial elevational view of the box insert shown in FIG. 3.

The box assembly 12*a* includes a box insert 68. As shown in FIGS. 3 and 4, the box insert 68 is generally rectangularly shaped and has a first side 70, a second side 72, a first end 74 and a second end 76. A first fold line 78 is formed on the box insert 68 extending generally between the first and the second ends 74 and 76 and spaced a distance from the first side 70. The box insert 68 also includes a second fold line 80 extending generally between the first and the second ends 74 and 76 and spaced a distance from the second side 72. The box insert 68 also includes a third fold line 79 and a fourth fold line 81. Each of the third and fourth fold lines 79 and 81 extend generally between the first end 74 and the second end 76 of the box insert 68. The third and fourth fold lines 79 and 81 are spaced a distance apart.

The first and third fold lines 78 and 79 are formed in the box insert 68 such that a portion of the box insert 68 extending between the first and the third fold lines 78 and 79 forms a first side wall portion 82 which is foldable in an upwardly direction extending generally perpendicularly from the remaining portion of the box insert 68. The second and the fourth fold lines 80 and 81 are formed in the box insert 68 such that a portion of the box insert 68 extending generally between the second and the fourth fold lines 80 and 81 forms a second side wall portion 84 which is foldable to a position wherein the second side wall portion 84 extends generally perpendicularly from the remaining portion of the box insert 68. The portion of the box insert 68 generally between the third fold line 79 and the forth fold line 81 forms a base portion 86.

The box insert 68 also include an inner surface 90 and an outer surface 92. An adhesive 94 is disposed on the inner surface 90 of the box insert 68. The adhesive 94 more particularly comprises three adhesive strips 96, 97 and 98. The adhesive strips 96, 97 and 98 are spaced a distance apart. Each of the adhesive strips 96, 97 and 98 extends generally between the first and the second side 70 and the second side 72 of the box insert 68.

In operation, the box insert 68 initially is folded along the third and forth fold lines 79 and 81. In this position, the box inserts 68 is disposed in the retaining space 34*a* of the box 14*a*with the outer surface 92 of the box insert 68 formed by the base portion 86 being disposed generally adjacent the inner surface 38*a* of the box 14*a*. The first side wall portion 82 extends generally along the first side wall of the box 14*a* and the second side wall portion 84 of the box insert 68 extends generally along the second side wall of the box 14*a*. The base portion 86 of the box insert 68 extends generally over the base of the box 14*a*. In this embodiment, the base portion 86 and the first and the second side wall portions 82 and 84 cooperate to form a portion of the retaining space 34*a*. The floral grouping assemblies 18 are disposed in the retaining space 34*a* and positioned generally on the box insert 68*a*, or more particularly, positioned generally on the base portion 86 of the box insert 68*a*. The adhesive strips 96, 97 and 98 removably and adhesively connect each of the floral grouping assemblies 18 to the box insert for substantially preventing movement of the floral grouping assemblies in the box 14*a* during movements or shipment of the box 14*a* in a manner like that described before with respect to the box assembly 12 shown in FIGS. 1 and 2.

The portion of the box insert 68 generally between the first fold line 78 and the first side 70 forms a lid flap portion of the box insert and the portion of the box insert 68 generally between the second fold line 80 and the second side 72 of the box insert 68 forms another lid portion of the box insert 68. After the floral grouping assemblies have been disposed in the retaining space 34*a*, the lid flap portions of the box insert then are folded along the respective fold line 78 and 82 to a position wherein the lid flap portions of the box inserts extend generally over the open upper end 32*a* of the box 14a. The portions of the adhesive strips 96, 97 and 98 extending over the lid flap portions of the box insert 68 extend over the floral grouping assemblies 18 and removably and adhesively connect each of the floral grouping assemblies to the lid flap portions of the box insert 68 for cooperating to substantially prevent movement of the floral grouping assemblies 18 and the box 14*a* during movements or shipment of the box 14*a* in a manner like that described before with respect to the box assembly 12 shown in FIGS. 1 and 2.

After the lid flap portions of the box insert 68 have been moved to the closed position extending generally over the open upper end 32*a*, the lid flaps 61*a*, 62*a*, 63*a* and 64*a* are moved to the closed position for closing the open upper end 32*a* of the box 14*a*.

EMBODIMENT OF FIG. 5

Figure 5:
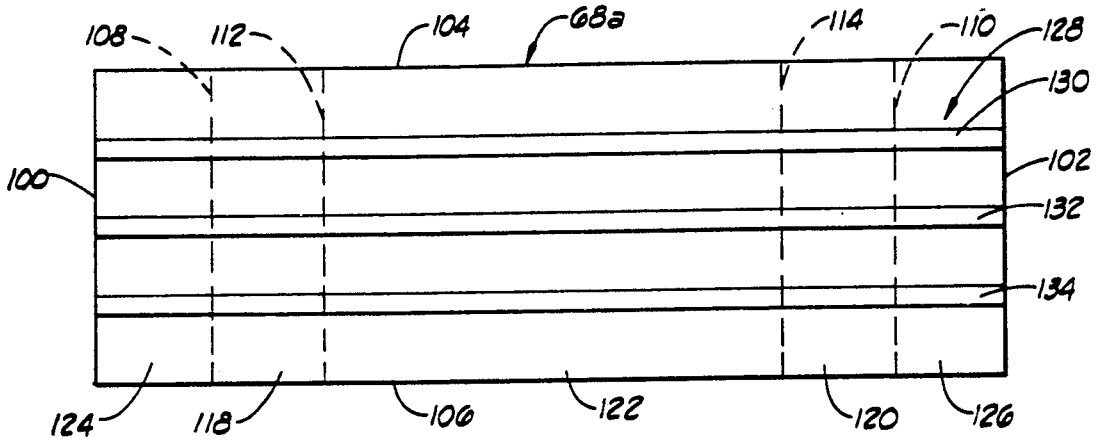
FIG. 5 is a plan view of a modified box insert which may be utilized with the box shown in FIG. 3.

Shown in FIG. 5 is a modified box insert 68*a*. The box insert 68*a* has a first end 100, a second end 102, a first side 104 and a second side 106. A first fold line 108 is formed on the box insert 68*a* extending generally between the first and the second sides 104 and 106. The first fold line is spaced a distance from the first end 100 of the box insert 68*a*. A second fold line 110 is formed in the box insert 68*a* extending generally between the first and the second sides 104 and 106. The second fold line 110 is spaced a distance from the second end 102 of the box insert 68*a*. A third fold line 112 is formed in the box insert 68*a* extending generally between the first and the second sides 104 and 106. The third fold line 112 is spaced a distance from the first fold line 108. A fourth fold line 114 is formed in the box insert 68*a* extending generally between the first and the second sides 104 and 106. The fourth fold line 114 is spaced a distance from the second fold line 110.

The first fold line 108 is spaced a distance from the third fold line 112 forming a first side wall portion 118 extending generally between the first and the third fold lines 108 and 112. The fourth fold line 114 is spaced a distance from the second fold line 110 forming a second side wall portion 120 extending generally between the second and the fourth fold lines 110 and 114. The third fold line 112 is spaced a distance from the fourth fold line 114 forming a base portion 122 extending generally between the third and the fourth fold lines 112 and 114.

In operation, the box insert 68*a* is initially folded along the third and fourth fold lines 112 and 114. In this position, the box insert 68*a* is inserted into the retaining space of a box constructed exactly like the box 14*a* shown in FIG. 3 and described in detail before. The first side wall portion 118 extends generally along and over the first end wall of the box 14*a* and the second side wall portion 120 extends along and over the second end wall of the box 14*a*.

The first fold line 108 is spaced a distance from the first end 100 of the box insert 68 forming a first lid flap 124. The second fold line 110 is spaced a distance from the second end 102 of the box insert 68 forming a second lid flap 126. When the box insert 68*a* is disposed in the retaining space 34*a*, the lid flap portions 124 and 126 each extend a distance above the open upper end 32*a* of the box 14*a*.

The box insert 68*a* includes adhesive 128 applied to a portion of the inner surface thereof. More particularly, the adhesive 128 comprises three adhesive strips 130, 132 and 134. Each of the adhesive strips 130, 132 and 134 extends generally between the first and the second ends 100 and 102 of the box insert 68. The adhesive strips 130, 132 and 134 each are spaced a distance apart.

After the box insert 68*a* has been disposed in the retaining space 34*a*, the floral grouping assemblies then are disposed in the retaining space 34*a* to a position wherein a portion of each of the floral grouping assemblies 18 removably and adhesively connects to at least one of the adhesive strips 130, 132 and 134 for removably and adhesively connecting each of the floral grouping assemblies to the box insert 68*a* for substantially preventing movement of the floral grouping assemblies in the box 14 a during movement or shipment of the box 14*a*. After the floral grouping assemblies have been disposed in the retaining space 34*a*, the lid flap portions 124 and 126 then are each folded generally along a respective fold lines 108 and 110 to a position wherein each of the lid flap portions 124 and 126 extends generally over the open upper end 32*a* of the box 14*a*. In this position, a portion of at least one of the adhesive strips 130, 132 and 134 on the respective lid flap portions 124 and 126 removably and adhesively connects to a portion of one of the floral grouping assemblies for substantially prevent movement of the floral grouping assemblies in the box 14*a* during movement or shipment of the box 14*a*.

EMBODIMENT OF FIGS. 6 AND 7

Figure 6:
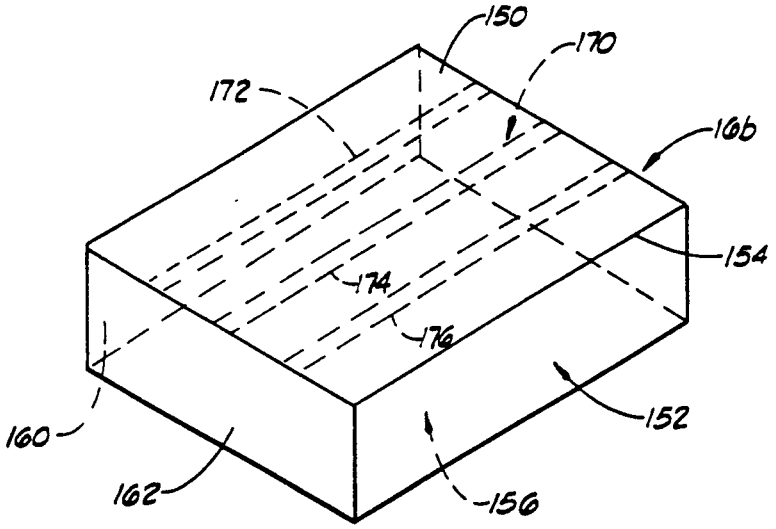
FIG. 6 is a partial elevational view of a modified box lid.
Figure 7:
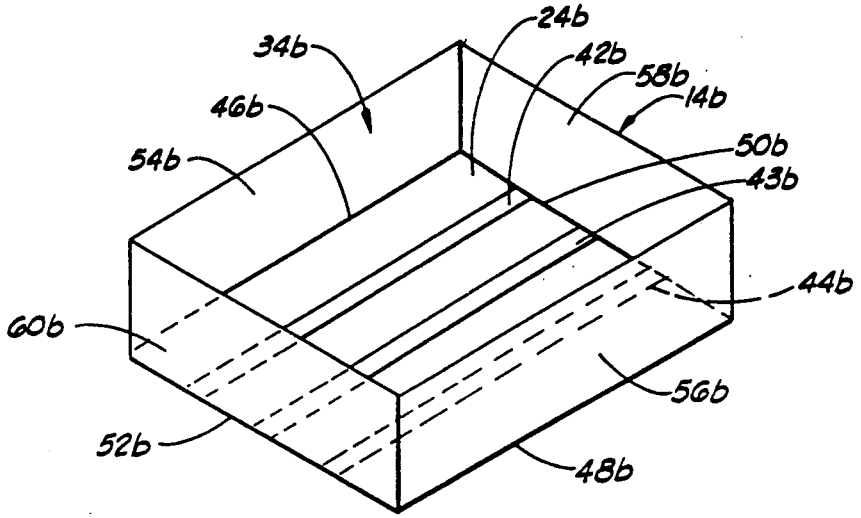
FIG. 7 is a partial elevational view of still another modified box which is used with the box lid shown in FIG. 6.
Figure 5:
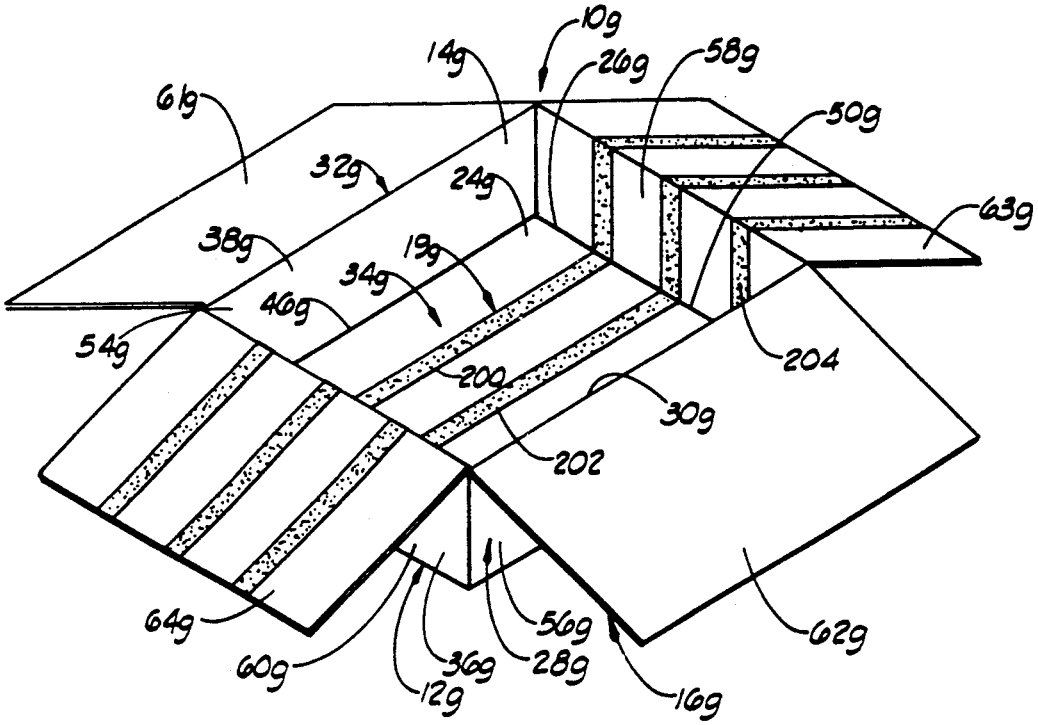
Figure 5:
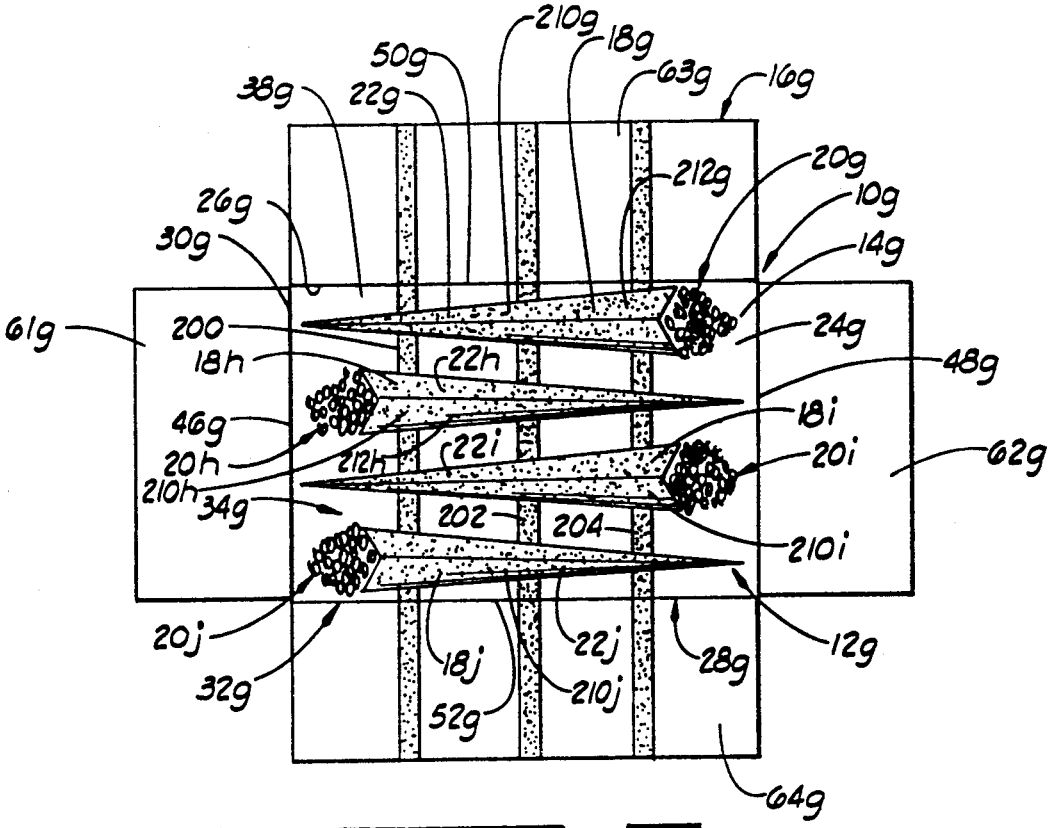

Shown in FIG. 6 is another modified box assembly. The box assembly includes a box 14*b* (FIG. 7) which is constructed exactly like the box 14 shown in FIGS. 1 and 2 and described in detail before, except the adhesive strips 42, 43 and 44 only extend over the base 24*b* and do not extend over the side walls 58*b* and 60*b*, and the box 14*b* does not. The box assembly 12*b* also includes a box lid 16*b* (FIG. 6) the box lid 16*b* has a base 150 and side walls 152. The side walls 152 are connected to the base 150 and extend generally about an entire outer periphery 154 of the base 150. The side walls 152 each extend generally perpendicularly from the base and cooperate with the base to form a box receiving space 156. The box lid 16*b* has an inner surface 160 and an outer surface 162. An adhesive 170 disposed on a portion of an inner surface 160 of the box lid 16*b*. The adhesive 170 more particularly comprises three adhesive strips 172, 174 and 176. The adhesive strips 172, 174 and 176 are spaced a distance apart.

In operation, the floral grouping assemblies are disposed in the retaining space 34*b* of the box 14*b*. The adhesive strips 42*b*, 43*b* and 44*b* each removably and adhesively connect the floral grouping assemblies 18 to the box 14*b*. The box lid 16*b* then is placed over the open upper end 32*b* of the box 14*b* to a position wherein the adhesive strips 172, 174 and 176 each removably and adhesively connect each of the floral grouping assemblies 18 to the box lid 166 for removably and adhesively connecting the floral grouping assemblies 18 to the box lid 166 for substantially preventing movement of the floral grouping assemblies 18 in the box 14*b* during movements or shipment of the box 14*b*.

EMBODIMENT OF FIGS. 8 AND 9

Shown in FIGS. 8 and 9 is a shipping carton 10*g* which is constructed exactly like the shipping carton 10 shown in FIGS. 1 and 2, except the box assembly 12*g* does not include the adhesive 40 comprised of the adhesive strips 42, 43 and 44. Rather, the box 14*g* includes three strips of a cohesive with the individual strips being designated via the reference numerals 200, 202 and 204 in FIGS. 8 and 9. Each of the strips of cohesive 200, 202 and 204 are placed on the box assembly 12*g* exactly like the strips of adhesive 42, 43 and 44 on the box 12 shown in FIGS. 1 and 2 and described in detailed before.

The box assembly 12*g* is adapted to retain floral grouping assemblies 18*g*, 18*h*, 18*i* and 18*j*. Each floral grouping assembly 18*g*, 13*h*, 18*i* and 18*j* consists of a floral grouping 20*g*, 20*h*, 20*i* and 20*j* respectively with each floral grouping 20*g*, 20*h*, 20*i* and 20*j* being retained in a sleeve 22*g*, 22*h*, 22*i* and 22*j* respectively. The floral grouping assemblies 18*g*, 18*h*, 18*i* and 18*j* are constructed exactly like the floral grouping assemblies 18 shown in FIGS. 1 and 2, except each sleeve 22*g*, 22*h*, 22*i* and 22*j* includes an outer peripheral surface 210*g*, 210*h*, 210*i* and 210*j* respectively and a cohesive 212*g*, 212*h*, 212*i* and 212*j* is disposed on an outer surface of each of the sleeves 22*g*, 22*h*, 22*i* and 22*j*. In operation, the floral grouping assemblies 18*g*, 18*h*, 18*i* and 18*j* each are disposed in the retaining space 34*g* and positioned so that portions of the cohesive 212*g*, 212*h*, 212*i* and 212*j* on the respective sleeves 22*g*, 22*h*, 22*i* and 22*j* contacts portions of the cohesive 200, 202 and 204 for releasably and cohesively connecting each of the floral grouping assemblies 18*g*, 18*h*, 18*i* and 18*j* to the box 14*g* and the lid flaps 63*g* and 64*g*.

EMBODIMENT OF FIGS. 10 AND 11

Figure 10:
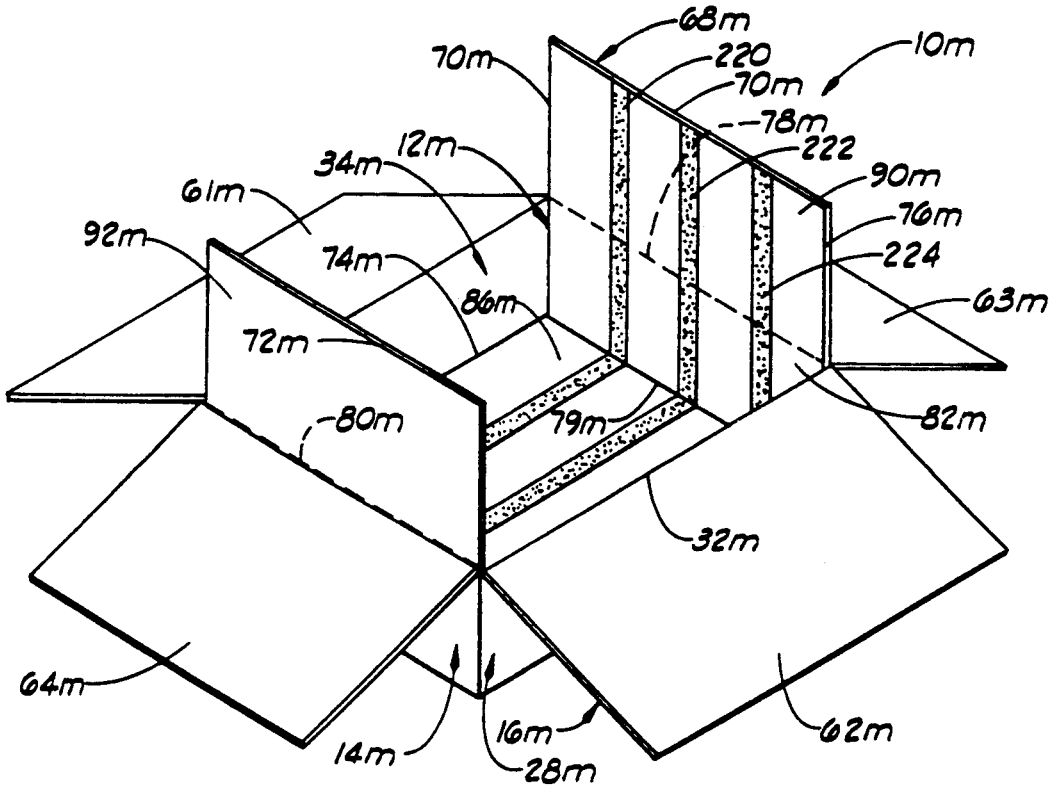
FIG. 10 is a partial elevational view of a modified box assembly, similar to the box assembly shown in FIG. 3, but showing a cohesive on the box insert.
Figure 11:
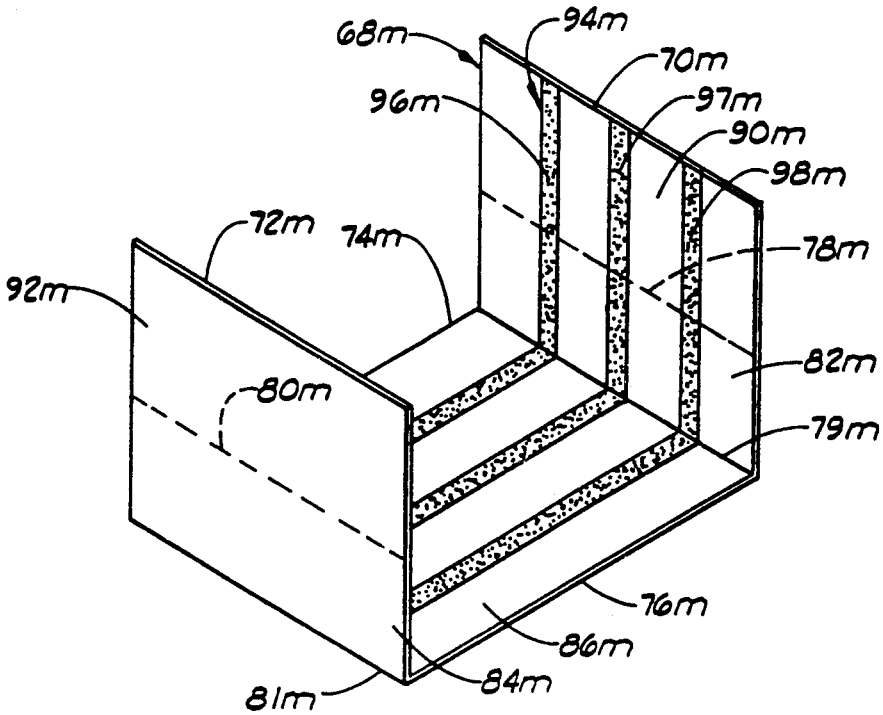
FIG. 11 is a partial elevational view of the box insert shown in FIG. 10.

Shown in FIGS. 10 and 11 is a shipping carton 10*g* which includes a box 14*g* and a box insert 68*g* which are constructed exactly like the box 14*a* and the box insert 68 shown in FIGS. 10 and 11 the adhesive 94. Rather, the box insert 68*g* includes three strips of cohesive 220, 222 and 224. The strips of cohesive 220, 222 and 224 are positioned and placed on the box insert 68*g* exactly like the strips of adhesive 96, 97 and 98 on the box insert 68 shown in FIGS. 3 and 4. In this embodiment, the floral grouping assemblies 18*g*, 18*h*, 18*i* and 18*j* shown in FIG. 9 are inserted into the retaining space 34*g* and the cohesive 212 on the sleeves 22 removably and cohesively connects to the cohesive strips 220, 222 and 224 for sibstantially preventing movement of the floral grouping assemblies 18 in the shipping carton 10*m*.

EMBODIMENT OF FIG. 12

Figure 12:
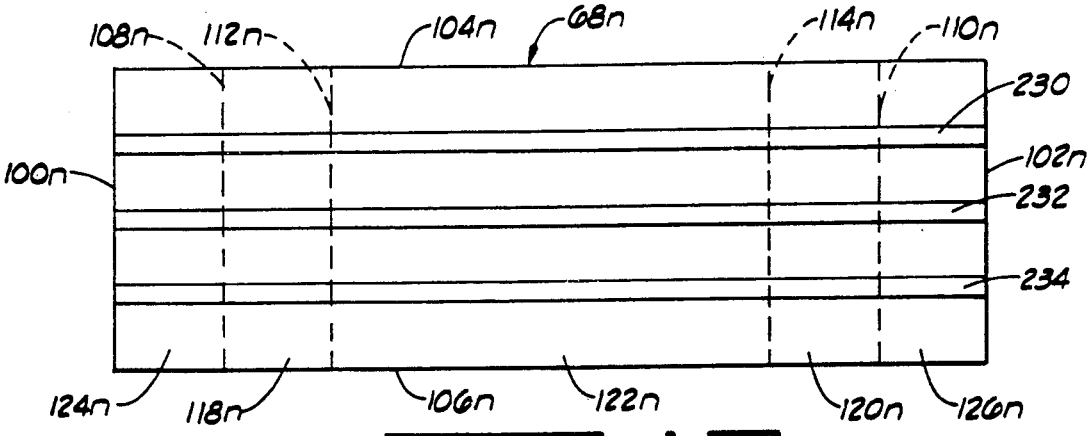
FIG. 12 is a plan view of a modified box insert, similar to FIG. 5, but showing a cohesive on the box insert.

Shown in FIG. 12 is a box insert 68*n* which is constructed exactly like the box insert 68*a* shown in FIG. 5 except the box insert 68m does not include the adhesive strips 130, 132 and 134. Rather, the box insert 68a includes cohesive strips 230, 232 and 234. The box insert 68n is inserted into the box in a manner exactly like that described before with respect to the box insert 68a shown in FIG. 5. The floral grouping assemblies 18g, 18h, 18i and 18j then are inserted into the retaining space where the cohesive strips 230, 232 and 234 cohesively and removably connect to the cohesive 212g, 212h, 212i and 212j on the sleeves 22.

EMBODIMENT OF FIGS. 13 AND 14

Figure 13:
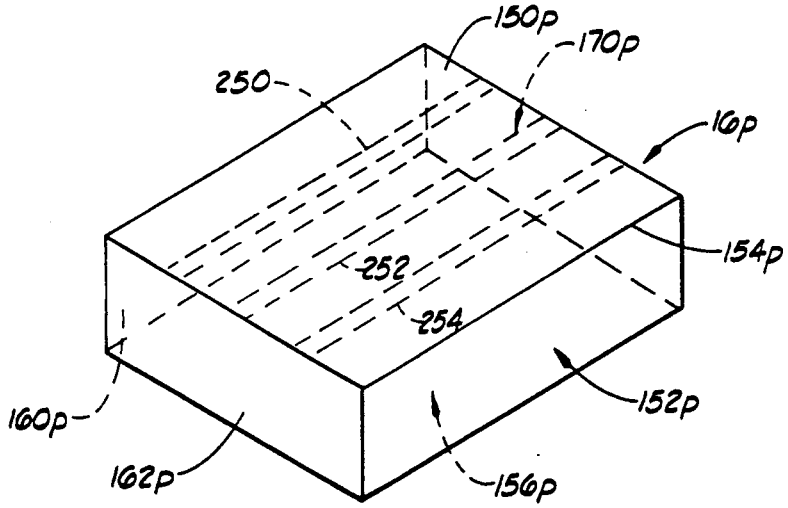
FIG. 13 is a partial elevational view of a modified box lid, similar to the box lid shown in FIG. 6, but showing a cohesive thereon.
Figure 14:
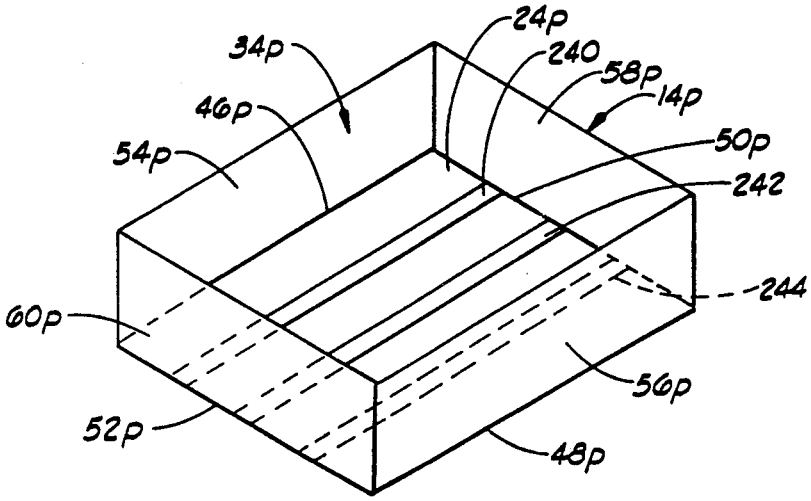
FIG. 14 is a partial elevational view of another modified box, similar to the box shown in FIG. 7, but showing a cohesive on the box, the box shown in FIG. 14 being used with the box lid shown in FIG. 13.

Shown in FIGS. 13 and 14 is a box 14p and a box lid 16p which are constructed exactly like the box 14b and the box lid 16b shown in FIGS. 13 and 14, except the box 14b does not include the adhesive strips 42b, 43b and 44b and the box lid 16p does not include the adhesive strips 172, 174 and 176. Rather, the box 14p includes cohesive strips 240, 242 and 244 and the box lid 16p includes cohesive strips 250, 252 and 254. When the floral grouping assemblies 18g, 18h, 18i and 18j are placed in the box 14p and the box lid 16p is disposed over the open upper end of the box 14p, the cohesive strips 240, 242 and 244 and the cohesive strips 250, 252 and 254 each will contact and cohesively connect to the sleeves 22g, 22h, 22i and 22j for preventing movement of the floral grouping assemblies 18 in the box 14p.

EMBODIMENT OF FIG. 15

Figure 15:
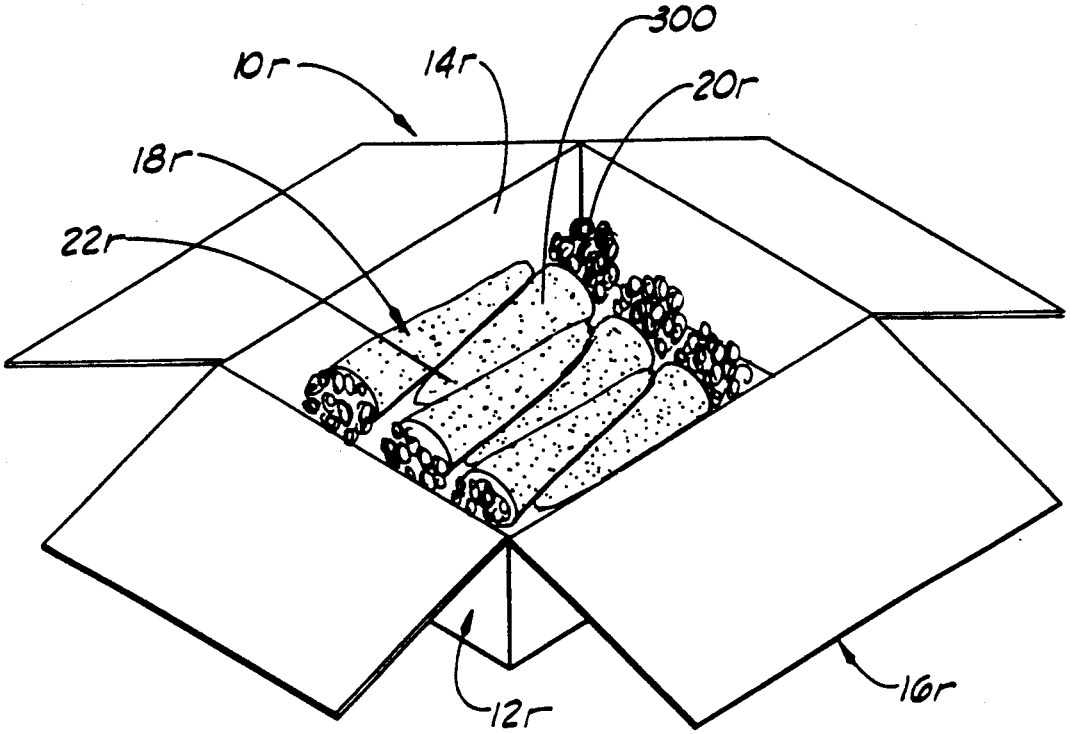
FIG. 15 is a perspective view of a modified box assembly having modified floral grouping assemblies disposed therein wherein the floral grouping assemblies have an adhesive or a cohesive material on a portion thereof.

Shown in FIG. 15 is a modified shipping carton 10r which includes a modified box assembly 12r. The modified box assembly 12r comprises a modified box 14r having a box lid 16r connected thereto. The box 14r is constructed exactly like the box 14 shown in FIG. 1 and the box lid 16r constructed exactly like the box lid 16r shown in FIG. 1, except the box 14r does not include an adhesive or cohesive on any portion thereof and the box lid 16r does not include adhesive or cohesive on any portion thereof.

As shown in FIG. 15, a plurality of floral grouping assemblies 18r are disposed in the box 14r (only one of the floral grouping assemblies 18r being designated with the reference numeral in FIG. 15). The floral grouping assemblies 18r each are constructed exactly like the floral grouping assemblies 18 shown in FIG. 1 and described in detailed before and each floral grouping assembly 18r includes a floral grouping 20r and a sleeve 22r, except the floral grouping assemblies 20r each include an adhesive or cohesive 300 disposed on a portion thereof. More particularly, the adhesive or cohesive 300 is disposed on the sleeve 22r of each floral grouping assembly 18r.

Assuming the material 300 is an adhesive, the adhesive 300 is disposed on each floral grouping assembly 18r such that, when the floral grouping assemblies 18r are disposed in the box 14r, the adhesive 300 on each floral grouping assembly 18r removably and adhesively engages a portion of the box assembly 12r and a portion of the adjacent floral grouping assembly 18r for removably connecting each of the floral grouping assemblies 18r to the box assembly 12r and/or to adjacent floral grouping assemblies 18r for substantially preventing movement of the floral grouping assemblies 18r in the box assembly 12r during movements (shipment) of the box assembly 12r.

Assuming the material 300 is a cohesive, the cohesive 300 is disposed on each floral grouping assembly 18r such that, when the floral grouping assemblies 18r are disposed in the box assembly 12r, the cohesive 300 material on each floral grouping assembly 18r removably and cohesively engages the cohesive material 300 on adjacent floral grouping assemblies 18r for removably and cohesively connecting each floral grouping assembly 18r to adjacent floral grouping assemblies 18r for substantially preventing movement of the floral grouping assemblies 18r in the box assembly 12r during movements (shipment) of the box assembly 12r.

EMBODIMENT OF FIG. 16

Figure 16:
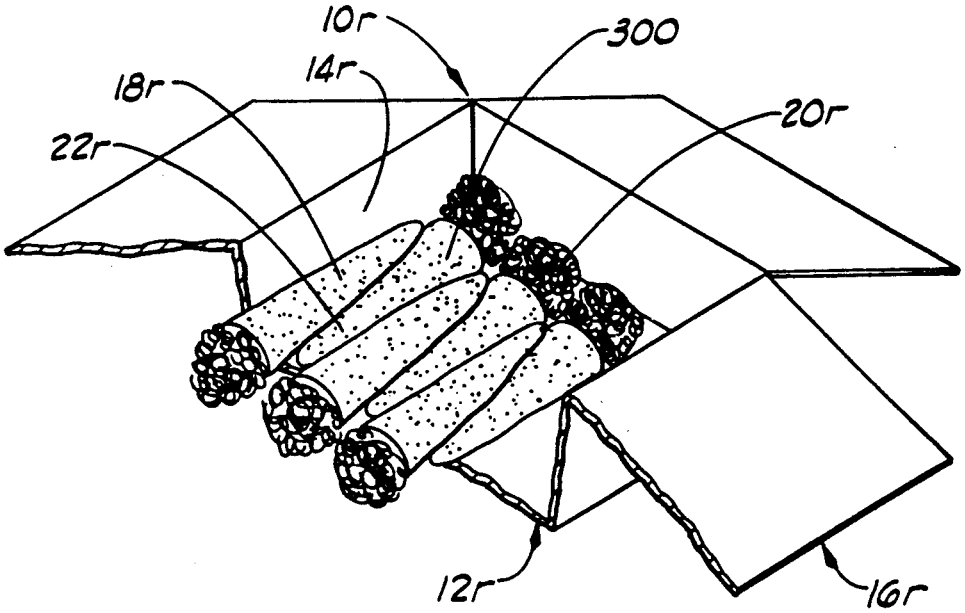
FIG. 16 is a view of another modified box assembly shown in cut away having floral grouping assemblies disposed therein, the floral grouping assemblies are constructed like the floral grouping assemblies shown in FIG. 15, except the floral grouping assemblies in FIG. 16 are shown layered with one layer of floral grouping assemblies being disposed on top of another layer of floral grouping assemblies.

Shown in FIG. 16 is a shipping carton 10r constructed exactly like the shipping carton 10r shown in FIG. 15 with floral groupings 18r disposed in the box 14r. The floral groupings 18r are constructed exactly like the floral groupings 18r are shown in FIG. 15 and include an adhesive or cohesive 300 disposed thereon. The only difference between the shipping carton 10r shown in FIG. 16 and the shipping carton shown in FIG. 15 is that the floral grouping assemblies 18r are shown in FIG. 16 disposed one on top of the other with a layer of floral grouping assemblies 18r being disposed near the bottom of the box and a second layer of floral grouping assemblies 18r being disposed on top of the first layer of floral grouping assemblies 18r disposed in the box 14r.

The floral grouping assemblies 18r, as shown in FIG. 16, will adhesively or cohesively adhere and connect to each other for substantially preventing movement of the floral grouping assemblies 18r in the box assembly 10r during movements (shipment) of the box assembly 12r in a manner like that described before with respect to the floral grouping assemblies 18r shown in FIG. 15.

EMBODIMENT OF FIGS. 17 AND 18

Figure 17:
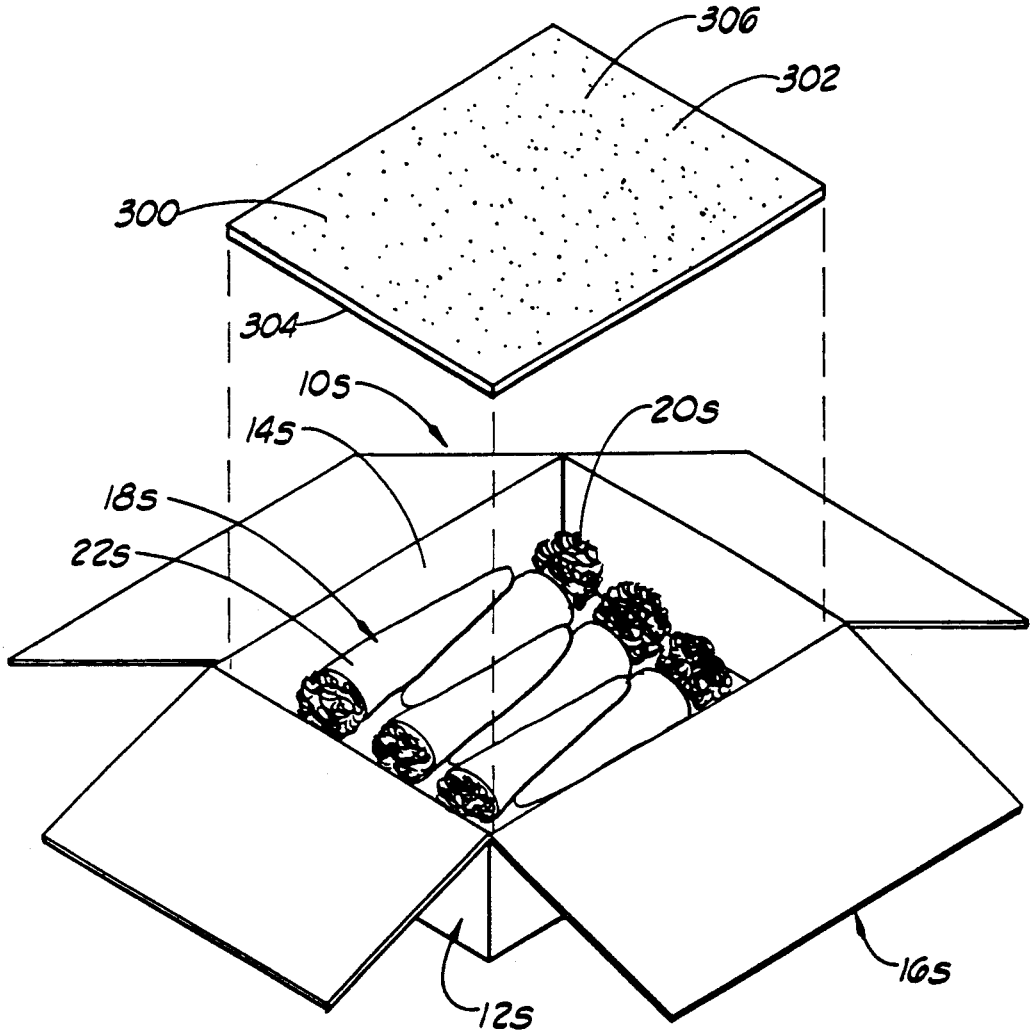
FIG. 17 is a perspective view of another modified box assembly showing floral grouping assemblies disposed therein wherein the box assembly includes a modified box insert, the box insert being shown in a position elevated above the box prior to the box insert being disposed in the box.

Shown in FIG. 17 is a shipping carton 10s which includes a box assembly 12s with floral grouping assemblies 18s disposed therein. The box assembly 12s is constructed exactly like the box assembly 12 shown in FIG. 1, except the box assembly 12s includes a box insert 300. The floral grouping assemblies 18s each are constructed like the floral grouping assemblies 18 shown in FIG. 2.

The box insert 300 includes an upper surface 302 and a lower surface 304. An adhesive 306 is disposed on the upper surface 302 of the box insert 300 and an adhesive 308 is disposed on the lower surface 304 of the box insert 300. The box insert 300 is rectangular or square shaped and is sized to fit in the retaining space of the box 14s.

In operation, the floral grouping assemblies 18s are disposed in the retaining space in the box 14s and the box insert 300 is disposed in the retaining space of the box 14s and positioned so that the lower surface 304 of the box insert 300 is disposed adjacent the floral grouping assemblies 18s whereby the adhesive 308 on the lower surface 304 of the box insert 300 adhesively engages a portion of the floral grouping assemblies 18s thereby adhesively and removably connecting each of the floral grouping assemblies 18s to the box insert 300 for substantially preventing movement of the floral grouping assemblies 18s in the box assembly 12s during movements (shipment) of the box assembly 12s.

As mentioned before, the box insert also includes an adhesive 306 on the upper surface 302 thereof. Thus, additional floral grouping assemblies 18s (not shown) can be placed on the upper surface 302 of the box insert 300 and positioned so that the adhesive 306 on the upper surface 302 removably and adhesively connects each of the floral grouping assemblies 18s to the upper surface 302 of the box insert 300 thereby substantially preventing movement of the floral grouping assemblies 18s in the box assembly 12s during movements (shipment) of the box assembly 12s.

EMBODIMENT OF FIGS. 19 AND 20

Figure 18:
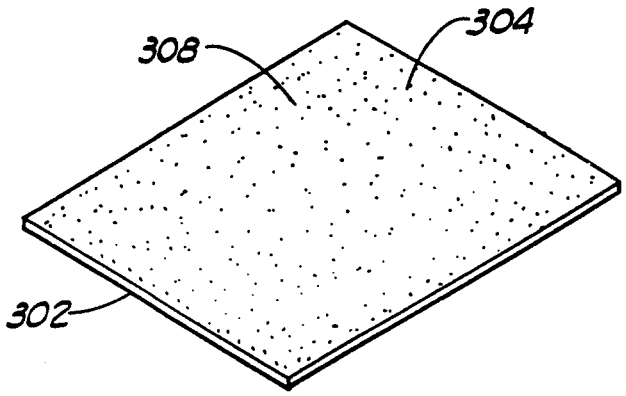
FIG. 18 is a partial perspective view of the box insert of FIG. 17, but showing the opposite side of the box insert.
Figure 19:
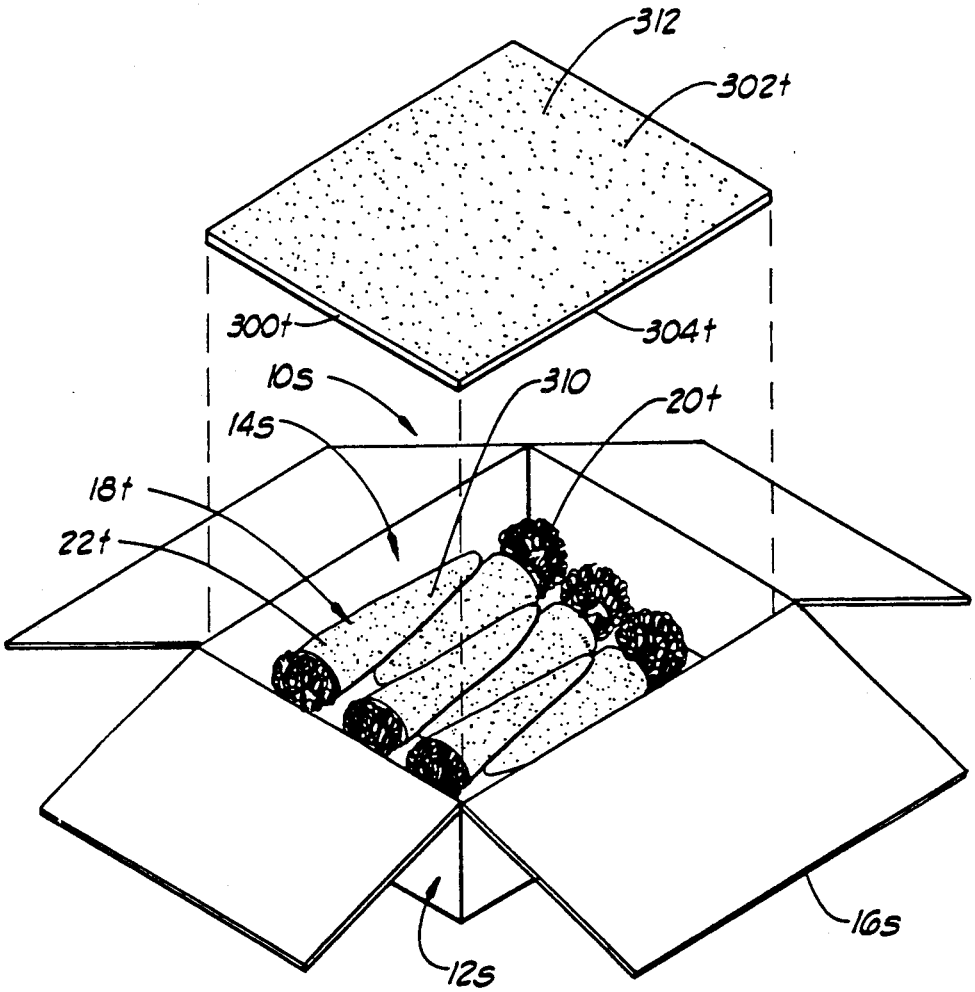
FIG. 19 is a perspective view showing another modified box assembly with floral grouping assemblies disposed therein wherein the box assembly and the floral grouping assemblies are constructed exactly like the box assembly and floral grouping assembly shown in FIGS. 17 except the floral grouping assemblies shown in FIG. 19 include a cohesive disposed on a portion thereof.
Figure 20:
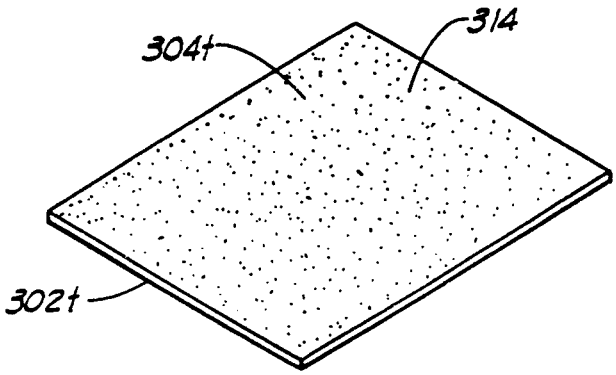
FIG. 20 is a perspective view of the box insert of the box assembly shown in FIG. 19.

Shown in FIG. 19 is a modified shipping carton 10s which includes the modified box assembly 12s comprising the modified box 14s with the lid assembly 16s. The box assembly 12s is constructed exactly like the box assembly 12s shown in FIGS. 17 and 18 and described in detailed before.

A plurality of floral grouping assemblies 18t are disposed in the retaining space of the box 14s. The floral grouping assemblies 18t are constructed exactly like the floral grouping assemblies 18s shown in FIG. 17 and described before, except the floral grouping assemblies 18t each include a cohesive 310 disposed thereon. More particularly, the cohesive 310 is disposed on the sleeve 22s surrounding a portion of each of the floral groupings 20t.

The box assembly 12s also includes a modified insert 300t. The box insert 300t is constructed exactly like the box insert 300 shown in FIGS. 17 and 18, except the box insert 300t includes a cohesive 310 on the upper surface 302 thereof and a cohesive 312 on the lower surface 304 thereof.

The floral grouping assemblies 18t are disposed in the retaining space of the box assembly 14s and the box insert 300t then is disposed in the retaining space of the box 14s and positioned so that a portion of the cohesive 312 on the lower surface 304t thereof cohesively engages a portion of the cohesive 310 on each of the floral grouping assemblies 18t thereby cohesively and removably connecting each of the floral grouping assemblies 18t to the box insert 300t for substantially preventing movement of the floral grouping assemblies 18t during movements (shipment) of the box assembly 12s.

The box insert 300t also includes a cohesive 312 on the upper surface 302 thereof. When the box insert 300t is disposed on the floral grouping assemblies 18t additional floral grouping assemblies 18t may be placed on the upper surface 302t of the box insert 300t. The cohesive on each of these additional floral grouping assemblies 18t would engage and cohesively contact the cohesive 312 on the upper surface 302 of the box insert 300 for cohesively and removably connecting each of the floral grouping assemblies to the upper surface 302 of the box insert 300t.

EMBODIMENT OF FIGS. 21, 22 AND 23

Figure 21:
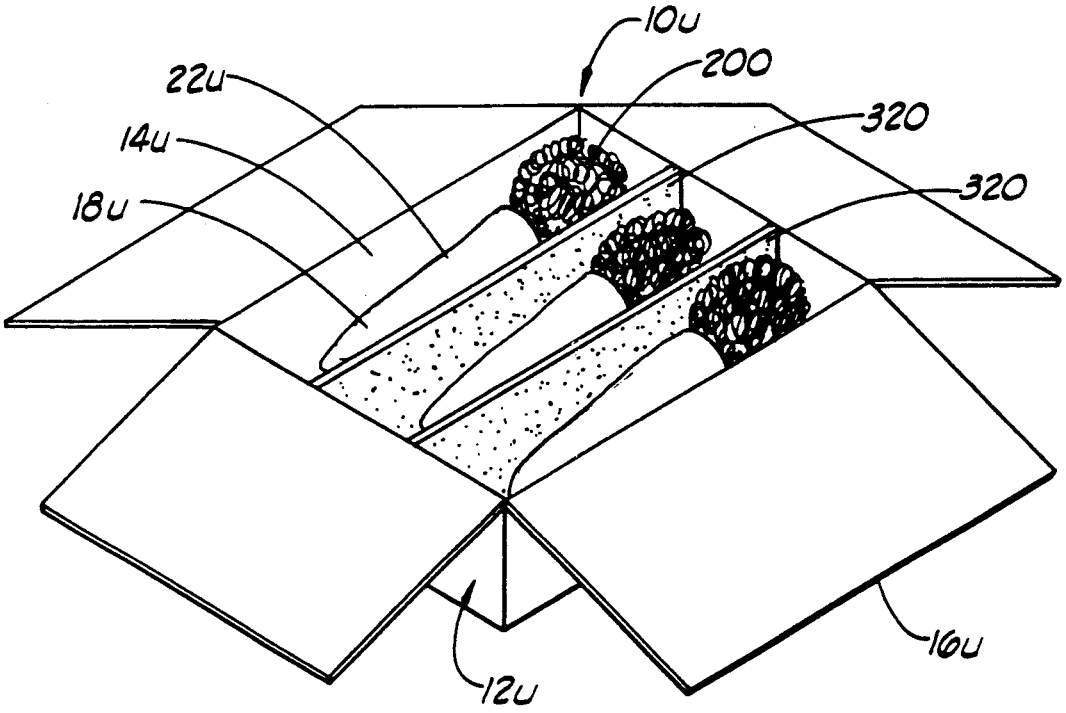
FIG. 21 is a perspective view of another modified box assembly having modified box inserts disposed therein.

Shown in FIG. 21 is a modified shipping carton 10u which includes a modified box assembly 12u which is constructed like the box assembly 12s shown in FIG. 21, except the box assembly 12u shown in FIG. 19 includes a plurality of box inserts 320. The box assembly 12u has a plurality of floral grouping assemblies 18u disposed in a retaining space portion thereof with the floral grouping assemblies 18u each being constructed exactly like the floral grouping assemblies 18s shown in FIG. 17.

Figure 22:
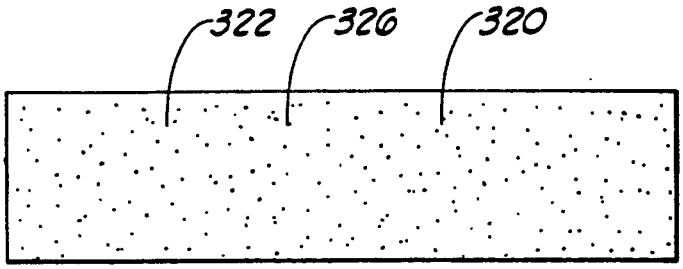
FIG. 22 is an elevational view of a typical box insert constructed like the box insert shown in FIG. 19.
Figure 23:
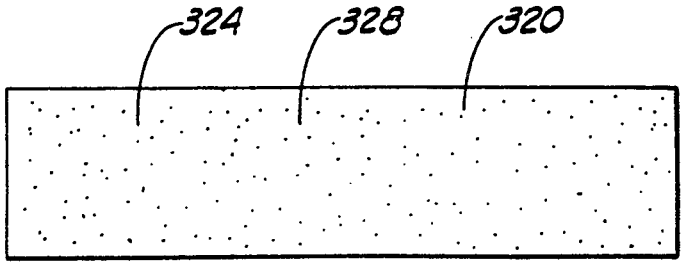
FIG. 23 is an elevational view of the box insert of FIG. 22, but showing the opposite side of the box insert as compared to the side shown in FIG. 22.

The box insert 320 are identical in construction and a typical box insert 320 is shown in FIGS. 22 and 23. Each box insert 320 includes a first side 322 and a second side 324. An adhesive 326 is disposed on the first side 322 of each box insert 320. An adhesive 328 is disposed on the second side 324 of each box insert 320.

In operation, the box inserts 320 are disposed in the retaining space of the box 14u with the box inserts 320 being spaced a distance apart. The box inserts 320 are disposed between adjacent floral grouping assemblies 18u and positioned so that a portion of the adhesive 326 and 328 on the first and the second sides 322 or 324 of each box insert 320 engages a portion of adjacent floral grouping assemblies 18u to adhesively connect each of floral grouping assemblies 18u to at least one of the box inserts 320 for substantially preventing movement of the floral grouping assemblies 18u in the box assembly 12u during movements (shipment) of the box assembly 12u. A portion of each box insert 320 engages a portion of the box assembly 12u to substantially prevent movement of the box inserts 320 in the box assembly 12u.

EMBODIMENT OF FIGS. 24, 25 AND 26

Figure 24:
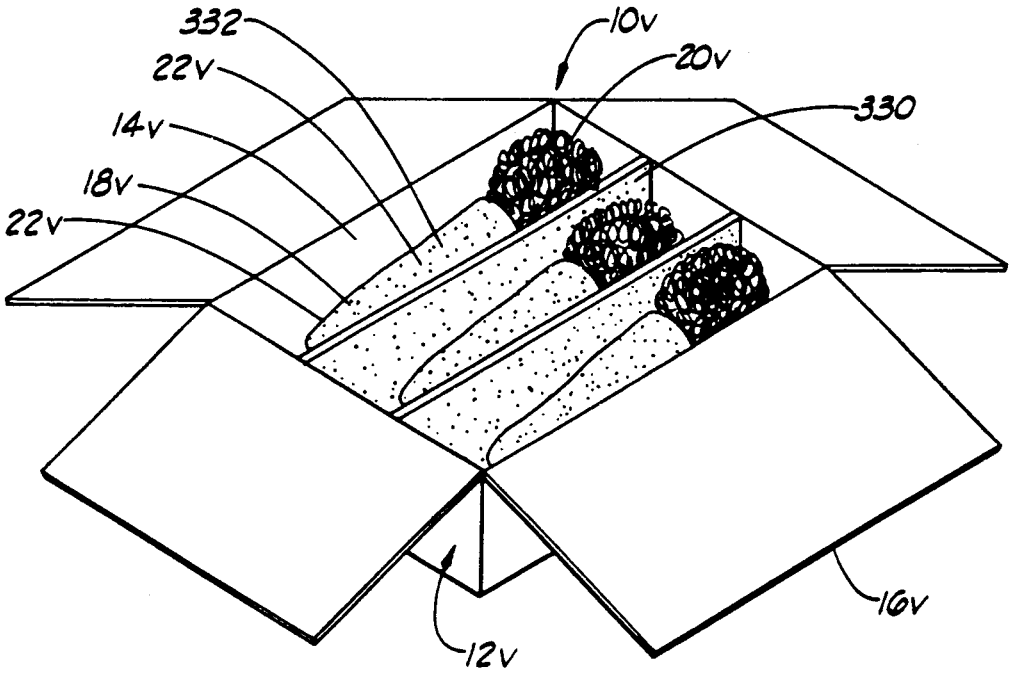
FIG. 24 is a perspective view of a box assembly similar to the box assembly shown in FIG. 21 except the box inserts include a cohesive disposed on a portion thereof and the floral grouping assemblies disposed in the box assembly each have a cohesive disposed on a portion thereof.
Figure 25:
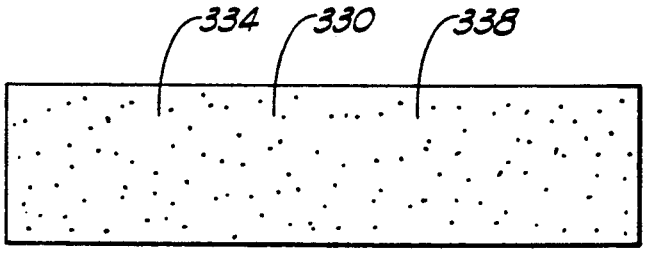
FIG. 25 is a plan view showing the upper surface of a typical box insert.
Figure 26:
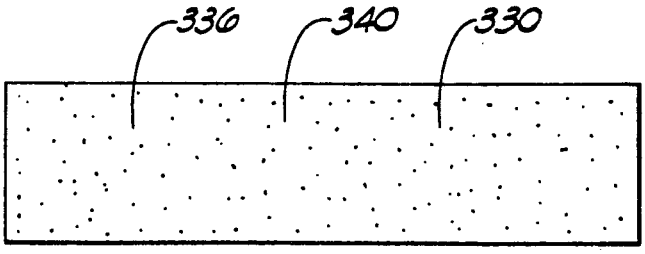
FIG. 26 is a plan view showing the lower surface of the box insert of FIG. 24.

Shown in FIG. 24 is a modified shipping carton 10v. The shipping carton 10v includes a box assembly 12v which is constructed exactly like the box assembly 12u shown in FIG. 21 and described before, except the box assembly 12v includes a plurality of modified box inserts 330 disposed in the retaining space portion of the box 14v. A plurality of floral grouping assemblies 18v are disposed in the retaining space of the box 14v and the floral grouping assemblies 18v each are constructed exactly like the floral grouping assemblies 18u shown in FIG. 21, except the floral grouping assemblies 18v each include a cohesive 332 disposed on a portion thereof. More particularly, the cohesive 332 is disposed on the sleeve 22v of each of the floral grouping assemblies 18v.

Each box insert 330 is rectangular or square shaped and has an upper surface 334 and a lower surface 336. A cohesive 338 is disposed on the upper surface 334 of each box insert 330. A cohesive 340 is disposed on the lower surface 336 of each box insert 330.

Each box insert 330 is disposed in the retaining space of the box 14v and disposed between two of the floral grouping assemblies 18v to a position wherein each box insert 330 engages a portion of the box assembly 12v for permitting movement of the box insert 330 during shipment of the box assembly 12v. Each box insert 330 is positioned so that the cohesive 338 on the upper surface 334 engages the cohesive 332 on one of the floral grouping assemblies 18v and so that the cohesive 340 on the lower surface 336 of each box insert 330 engage the cohesive 332 on one of the floral grouping assemblies 18v for cohesively connecting each of the floral grouping assemblies 18v to at least one of the box inserts 330 for substantially preventing movements of the floral grouping assemblies 18v during movements (shipment) of the box assembly 12v.

The term "sleeve" as used herein simply means a sheet of material adapted to be wrapped about a floral grouping and includes sheets of material preformed to provide a warp and sheets of material which are hand or otherwise formed about floral groupings.

Changes may be made in the construction and the operation of the various components, elements and assemblies described herein without departing from the spirit and scope of the invention as defined in the following claims.

What is claimed is:

1. A shipping carton comprising:

A box assembly having an inner surface and an outer surface and at least partially enclosing a retaining space; and A plurality of floral grouping assemblies, the floral grouping assemblies being disposed in the retaining space in the box assembly and each floral grouping assembly having an adhesive disposed on a portion thereof with the adhesive on the floral grouping assemblies removably and adhesively engaging an adjacent floral grouping assembly for connecting the floral grouping assemblies when the floral grouping assemblies are placed in the retaining space in the box assembly for substantially preventing movement of the floral grouping assemblies in the box assembly during movements of the box assembly.

2. The shipping carton of claim 1 wherein the box assembly further comprises:

a box having a base, side walls, an outer surface, an inner surface, the side walls being connected to the base and extending a distance upwardly from the base, the side walls extending about an outer periphery of the base and cooperating with the base to partially enclose the retaining space.

3. The shipping carton of claim 2 wherein the base of the box comprises a first end, a second end, a first side and a second side.

4. The shipping carton of claim 3 wherein the side walls comprise a first end wall extending along the first end of the base, a second end wall extending along the second end of the base, a first side wall extending along a first side of the base and a second side wall extending along the second side of the base.

5. The shipping carton of claim 2 wherein the side walls extend upwardly from the base forming an open upper end of the box, and wherein the box assembly further comprises:

a box lid removably connectable to the open upper end of the box, the lid cooperating with the side walls and the base to encompass the retaining space in a closed position.

6. The shiping carton of clain 1 wherein each floral grouping assembly comprises:

a floral grouping;

a sheet of material disposed about at least a portion of the floral grouping, the adhesive being disposed on the shet of material.

* * * * *

UNITED STATES PATENT AND TRADEMARK OFFICE

CERTIFICATE OF CORRECTION

PATENT NO. : 5,195,637

DATED : March 23, 1993

INVENTOR(S) : Weder, et al.

It is certified that error appears in the above-identified patent and that said Letters Patent is hereby corrected as shown below:

On the Title page, Inventor [75], after Highland, please add --; William F. Straeter, Breese; Joseph G. Straeter, Highland, all of Illinois--.

Column 3, Line 66, after side, please add--wall--.

Column 7, Lines 55 & 56; after 60b, please delete ", and the box 14b does not".

Column 8, Line 9, after lid, please delete "166" and substitute therefore --16b--.

Col. 8, Line 11, after lid, please delete "166" and substitute therefore --16b--.

UNITED STATES PATENT AND TRADEMARK OFFICE

CERTIFICATE OF CORRECTION

PATENT NO. : 5,195,637

DATED : March 23, 1993

INVENTOR(S) : Weder, et al.

It is certified that error appears in the above-identified patent and that said Letters Patent is hereby corrected as shown below:

Column 9, Line 15, after Figures, please delete "13 and 14" and substitute therefore --6 and 7--.

Column 12, Line 42, please delete "permitting" and subsitute therefore --substantially preventing--.

Column 14, Line 18; after The, please delete "shiping" and substitute therefore --shipping--.

Column 14, Line 23; after the, please delete "shet" and substitute therefore --sheet--.

Signed and Sealed this

Twenty-fifth Day of January, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,195,637
DATED : March 23, 1993
INVENTOR(S) : Donald E. Weder

It is certified that error appears in the above-identified patent and that said Letters Patent is hereby corrected as shown below:

Title page,
Item [*] Notice: after the word "to", please delete "Sep. 22, 2009" and substitute therefore "April 26, 2011".

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*